US007809319B2

(12) United States Patent
Fujii

(10) Patent No.: US 7,809,319 B2
(45) Date of Patent: Oct. 5, 2010

(54) FIXING DEVICE AND IMAGE FORMING APPARATUS HAVING LONGITUDINAL PRESSURE APPLYING SECTION

(75) Inventor: Makoto Fujii, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 104 days.

(21) Appl. No.: 12/177,360

(22) Filed: Jul. 22, 2008

(65) Prior Publication Data

US 2009/0074487 A1 Mar. 19, 2009

(30) Foreign Application Priority Data

Sep. 14, 2007 (JP) ..... 2007-239015

(51) Int. Cl.
*G03G 15/20* (2006.01)

(52) U.S. Cl. ..... 399/329; 399/67; 399/331; 219/216

(58) Field of Classification Search ..... 219/216; 399/67, 329–331
See application file for complete search history.

(56) References Cited

U.S. PATENT DOCUMENTS 6,983,119 B2 * 1/2006 Nakayama ..... 399/341

FOREIGN PATENT DOCUMENTS

JP 2005-189746 A 7/2005

* cited by examiner

*Primary Examiner*—Hoang Ngo
(74) *Attorney, Agent, or Firm*—Sidley Austin LLP

(57) ABSTRACT

A fixing device for conducting fixing by heating and pressurizing a recording material conveyed between a fixing member and a belt, having therein a pressing section that presses the recording material against a fixing member through a belt, a pressure applying section that generates pressing force proceeding to the pressing section, and a pressing force transmission section that is positioned between the pressing section and the pressure applying section and that transmits the pressing force to the pressing section, wherein the pressing force transmission section has plural first elastic members arranged in the same direction as the longitudinal direction of the pressing section, and the first elastic members have a plurality of different elastic coefficients.

12 Claims, 8 Drawing Sheets

FIXING DEVICE AND IMAGE FORMING APPARATUS HAVING LONGITUDINAL PRESSURE APPLYING SECTION

This application is based on Japanese Patent Application No. 2007-239015 filed on Sep. 14, 2007 in Japanese Patent Office, the entire content of which is hereby incorporated by reference.

BACKGROUND OF THE INVENTION

The present invention relates to a fixing device and to an image forming apparatus having therein the fixing device, and in particular to a fixing device of a belt type.

There has been known a fixing device of a belt type having a fixing roller, a belt that presses a recording material against the fixing roller and a pressing section that presses the belt against the fixing roller.

For avoiding deterioration of image quality, it is generally known about a fixing device that a nip pressure between a fixing roller and a belt needs to be increased in accordance with information relating to a recording material to be fixed (for example, a recording material thickness) or with fixing quality information (for example, the state of a gloss finished) .

In the foregoing document, it is known that there is a possibility that, when pressurization by a pressing section is increased for the purpose of increasing a nip pressure between a fixing roller and a belt, a nip pressure on a central part is reduced compared with edge portions of the fixing roller in the longitudinal direction, and targeted image quality cannot be obtained.

For the aforesaid problem, there is known the first fixing device (for example, see Unexamined Japanese Patent Application Publication No. 2005-189746) wherein there is provided a cam (a pressure applying section) in which a prescribed circumferential area is made to be a standard surface which is away from the center axis at a constant distance in the longitudinal direction of a pressing section, and a specific circumferential area is made to be a non-standard surface whose central portion is further away than the standard surface in the longitudinal direction of a pressing section. When applying ordinary nip pressure, namely, pressing pressure, the standard surface side of the cam (pressure applying section) is pressed against a heat roller, while when applying a nip pressure higher than the ordinary pressure, the non-standard surface side is pressed while facing the heat roller. Owing to this, a nip pressure decline on the aforesaid central part which is generated when a pressure higher than an ordinary pressure is applied is tried to be reduced.

Further, there is known the second fixing device (for example, see Unexamined Japanese Patent Application Publication No. 2005-189746) wherein a plurality of springs movable in the direction perpendicular to the longitudinal direction are arranged on a pressing section in its longitudinal direction. when applying ordinary nip pressure, namely, the pressing pressure, the pressing section is pressed against a heat roller, by positioning plural springs at the same location in the direction perpendicular to the longitudinal direction of the pressing section, while when applying nip pressure that is higher than an ordinary pressure, the pressing section is pressed against a heat roller under the condition where springs positioned at a central part among the plural springs are moved toward the heat roller side, and thereby, a decline of nip pressure on the central part which is caused when a nip pressure that is higher than an ordinary pressure is applied, is tried to be reduced.

However, in the first fixing device described in Unexamined Japanese Patent Application Publication No. 2005-189746), a pressurizing member that is made of rubber whose thickness is about 1-3 mm, for example, is pressed by a pressure applying section (cam) directly, thus, there has been a possibility that pressing force of the pressurizing member may be changed greatly by an extremely small difference in a cam shape (for example, approximately 0.1 mm), and image defects caused by fixing may be generated.

There has further been a problem that design and production of a cam are extremely delicate, and a cam needs to be designed and produced again when a necessary nip pressure is not obtained.

In the second fixing device described in Unexamined Japanese Patent Application Publication No. 2005-189746, the aforesaid problems can be solved because the springs are used for pressurization. However, there has been a problem that there is a possibility that plural devices which move plural springs respectively in the direction perpendicular to the longitudinal direction of pressing section are needed for changing pressure distribution in the longitudinal direction of the pressing section, whereby an apparatus becomes complicated in structure and large in size and frequency of failures is increased.

SUMMARY

In view of the aforesaid problems, an objective of the invention is to provide a fixing device capable of obtaining a high-quality output image having no image defects wherein the design and production are easy, the structure is simple, the size is small and the maintenability is excellent, and to provide an image forming apparatus having the aforesaid fixing device.

The above objective is achieved with the following embodiments of the invention.

(1) A fixing device which conducts a fixing process by heating and pressing a recording material, and which includes a fixing member, a belt which conveys the recording material between the fixing member and the belt, a pressing section which presses the recording material against the fixing member through the belt, a pressure applying section which generates pressing force, and a pressing force transmission section which is positioned between the pressing section and the pressure applying section and which transmits the pressing force to the pressing section, the pressing force transmission section comprising a plurality of first elastic members which are arranged in a same direction as a longitudinal direction of the pressing section and have a plurality of different elastic coefficients.

(2) An image forming apparatus having the fixing device of Item (1).

Figure 2:
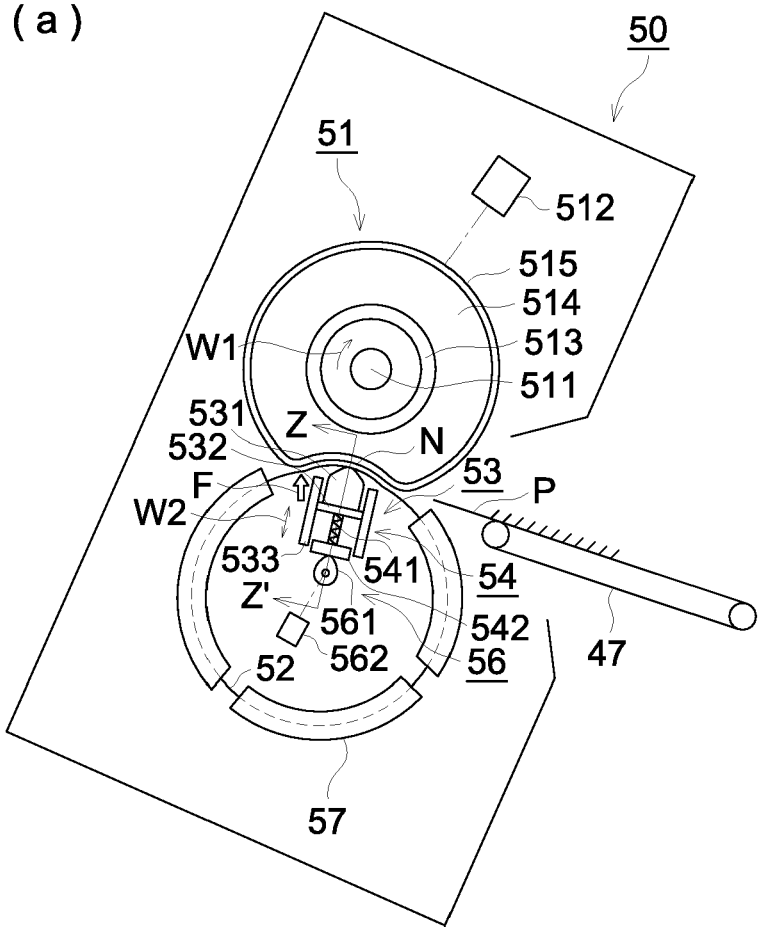
Figure 2:
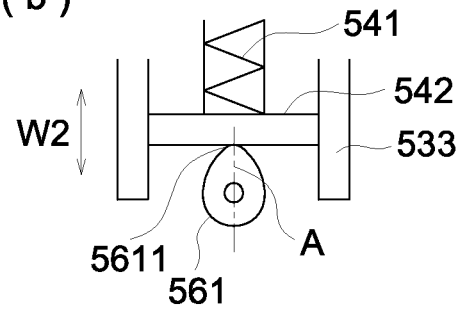
Figure 2:
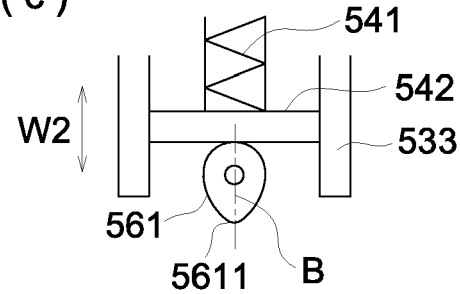

Each of FIG. 2 (*a*), FIG. 2 (*b*) and FIG. 2 (*c*) represents a structural diagram of a cross-section.

Figure 3:
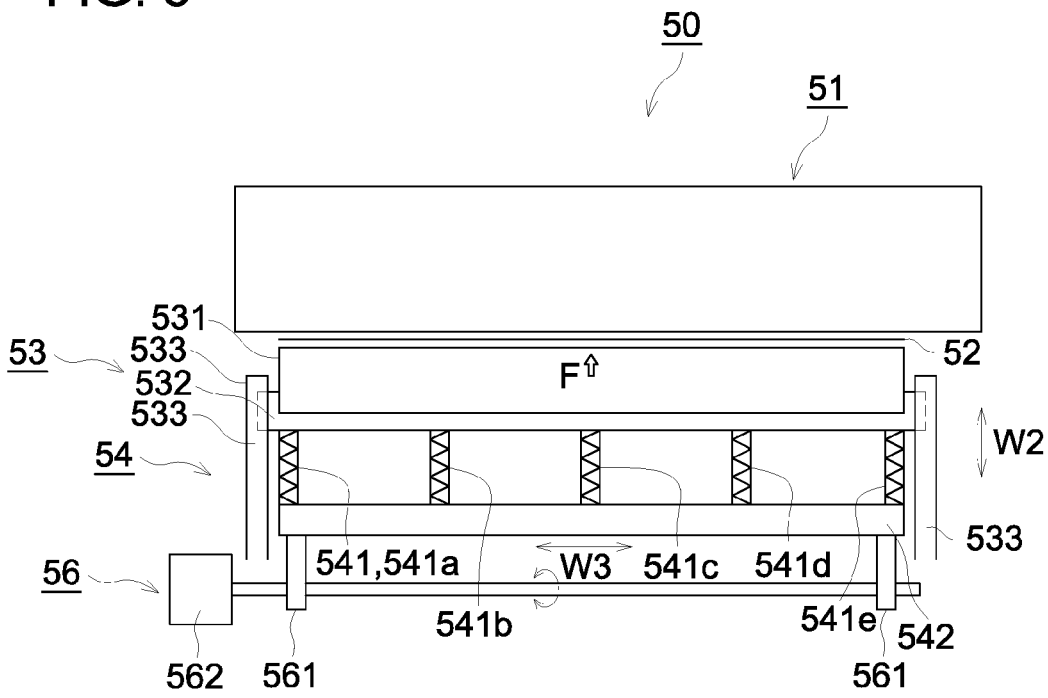

FIG. 3 is a partial sectional view of a fixing device.

Figure 4:
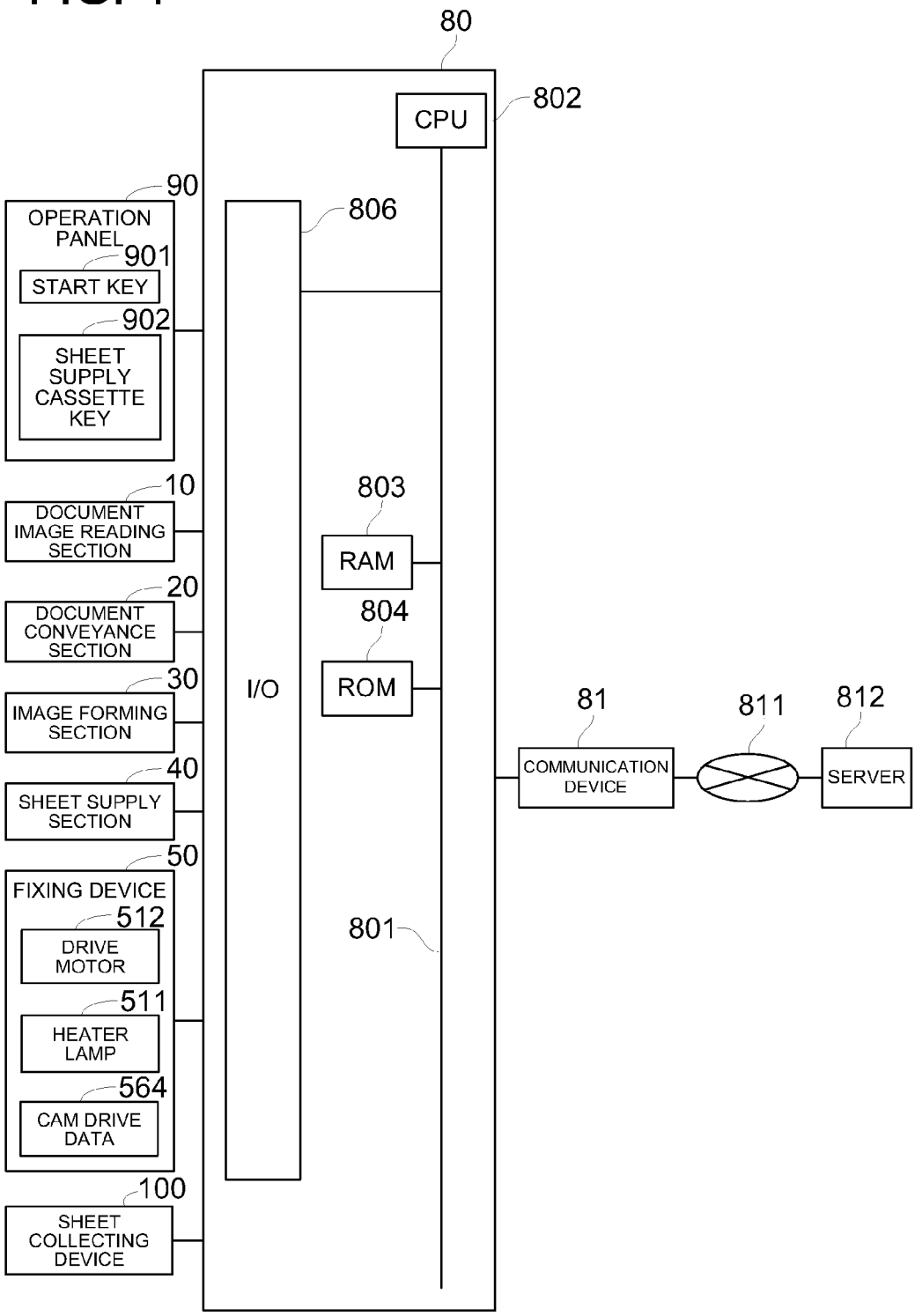

FIG. 4 is a block diagram relating to control of a fixing device and an image forming apparatus.

Figure 5:
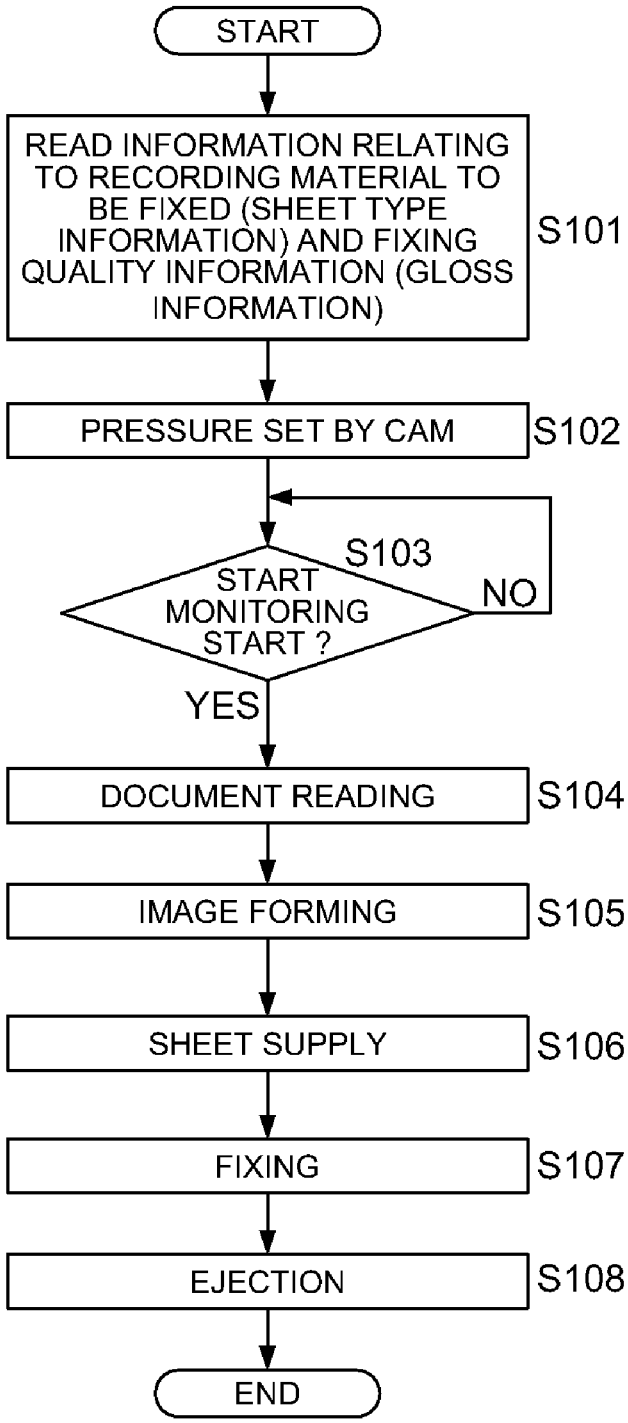

FIG. 5 is a flow diagram relating to control of an image forming apparatus.

Figure 6:
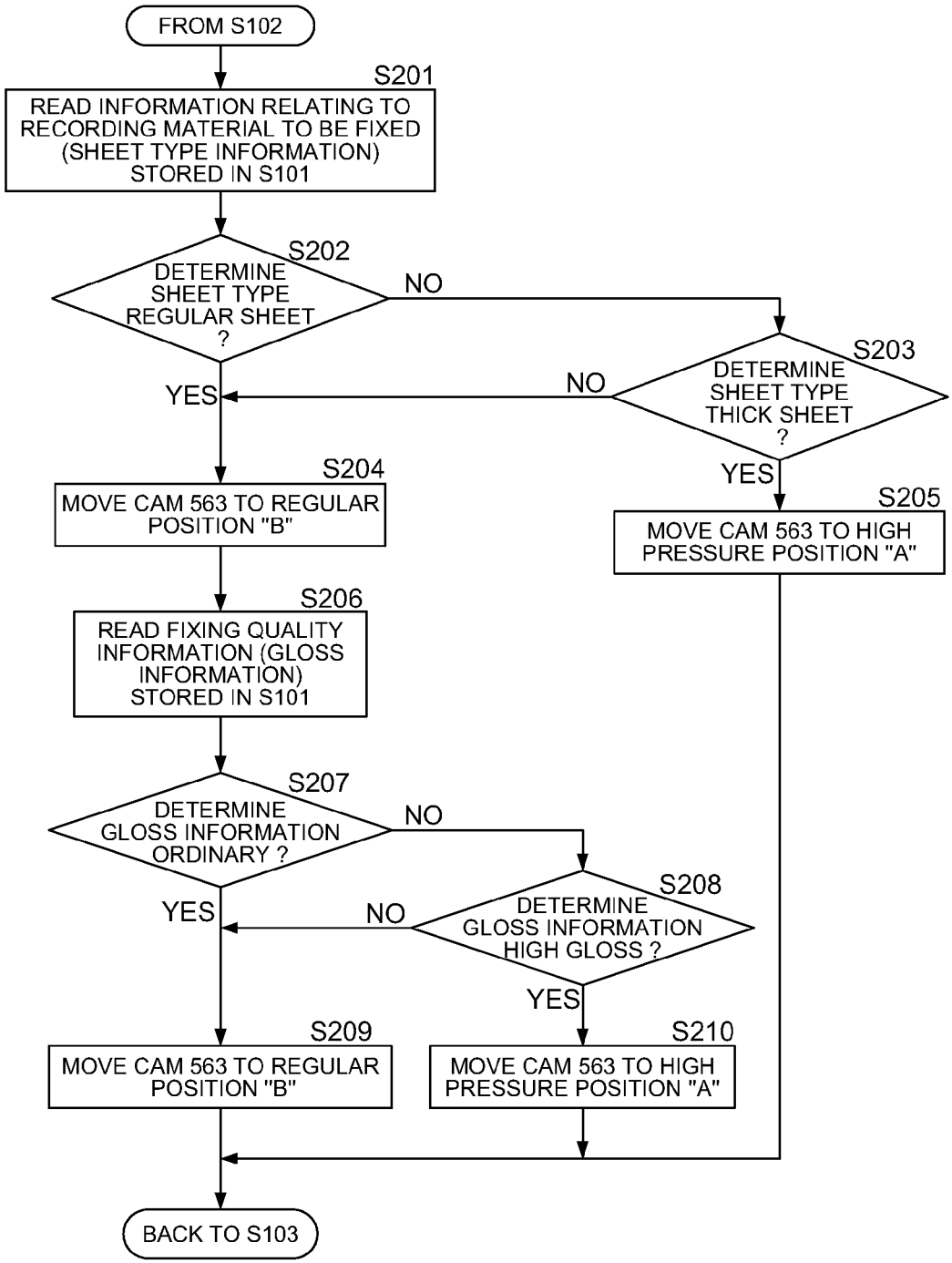

FIG. 6 is a flow diagram relating to setting of pressure by a cam of a fixing device.

Figure 7:
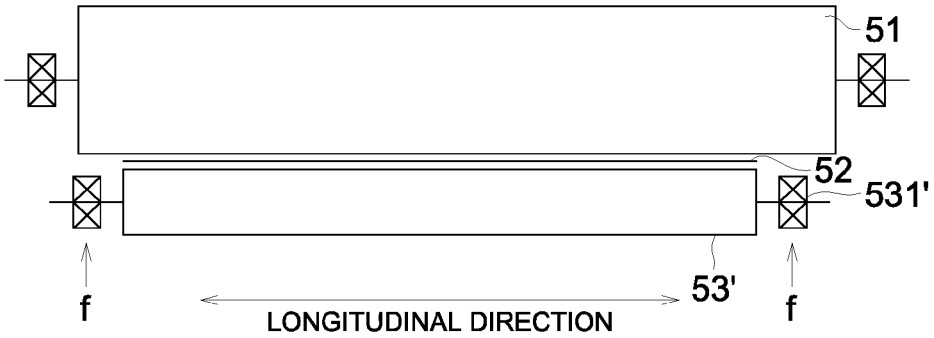
Figure 7:
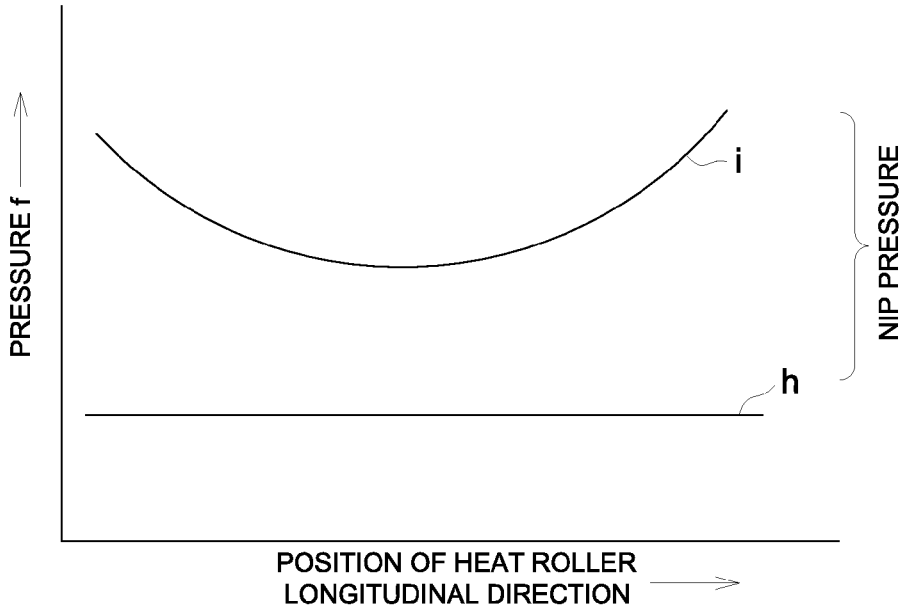

FIG. 7 (*a*) and FIG. 7 (*b*) are diagrams showing nip pressure distribution in a conventional fixing device conceptually.

Figure 8:
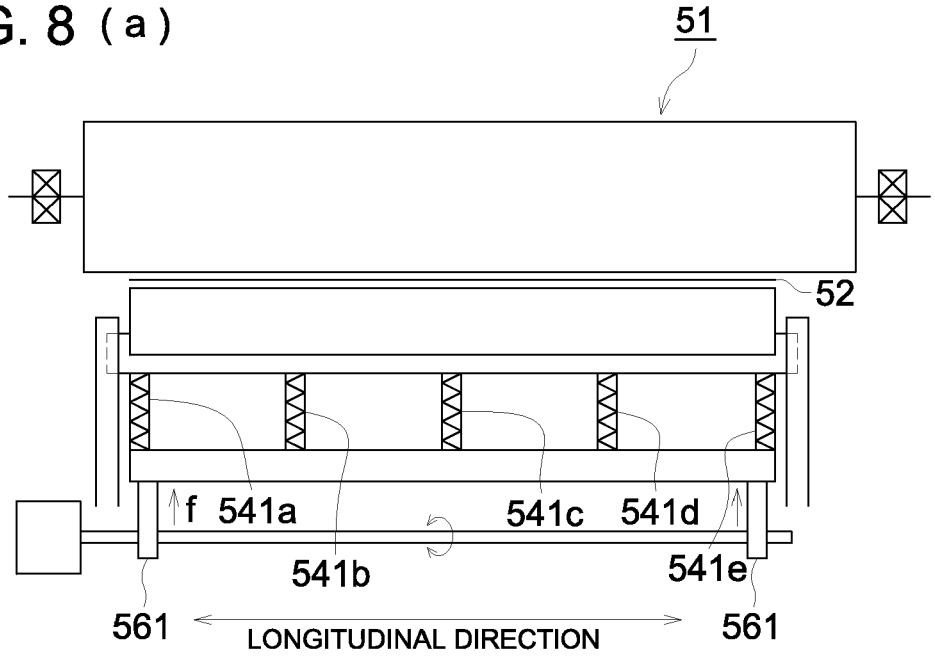
Figure 8:
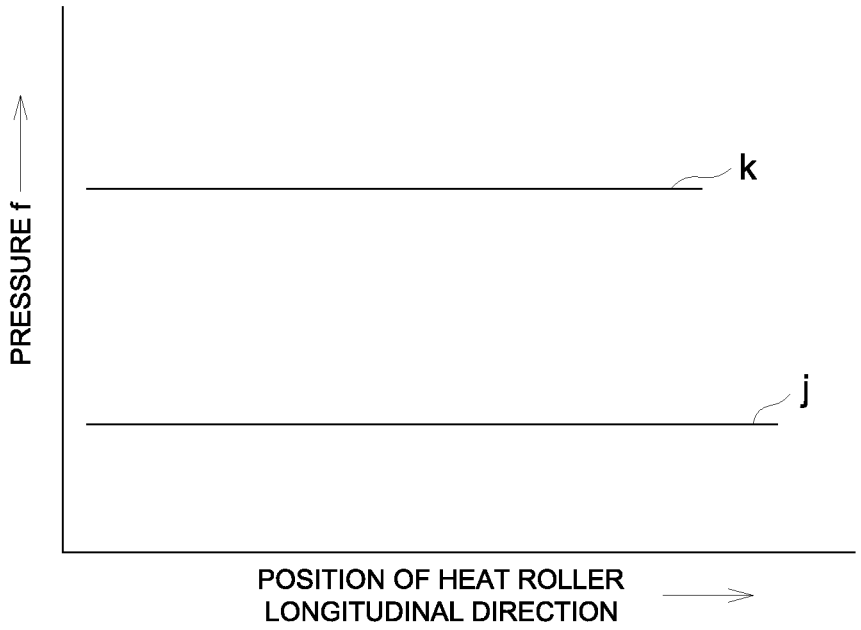

FIG. 8 (*a*) and FIG. 8 (*b*) are diagrams showing nip pressure distribution in the fixing device of the present embodiment conceptually.

DETAILED DESCRIPTION OF THE PREFERRED EMBODIMENT

The preferred embodiment for practicing the present invention will be described as follows, referring to drawings. Meanwhile, the structure of the invention is not limited to the following embodiment, and it can be varied properly without departing from the technical spirit and scope of the invention.

An image forming apparatus having the fixing device of the invention has only to be one that conducts fixing on a recording material and forms an image, and a copying machine, a printer, a FAX (facsimile machine) and a compound multi-functional terminal (MFP: Multi-Function Peripheral) are cited.

A description will be given as follows with an example of the image forming apparatus that is called a tandem type full color copying machine.

Figure 1:
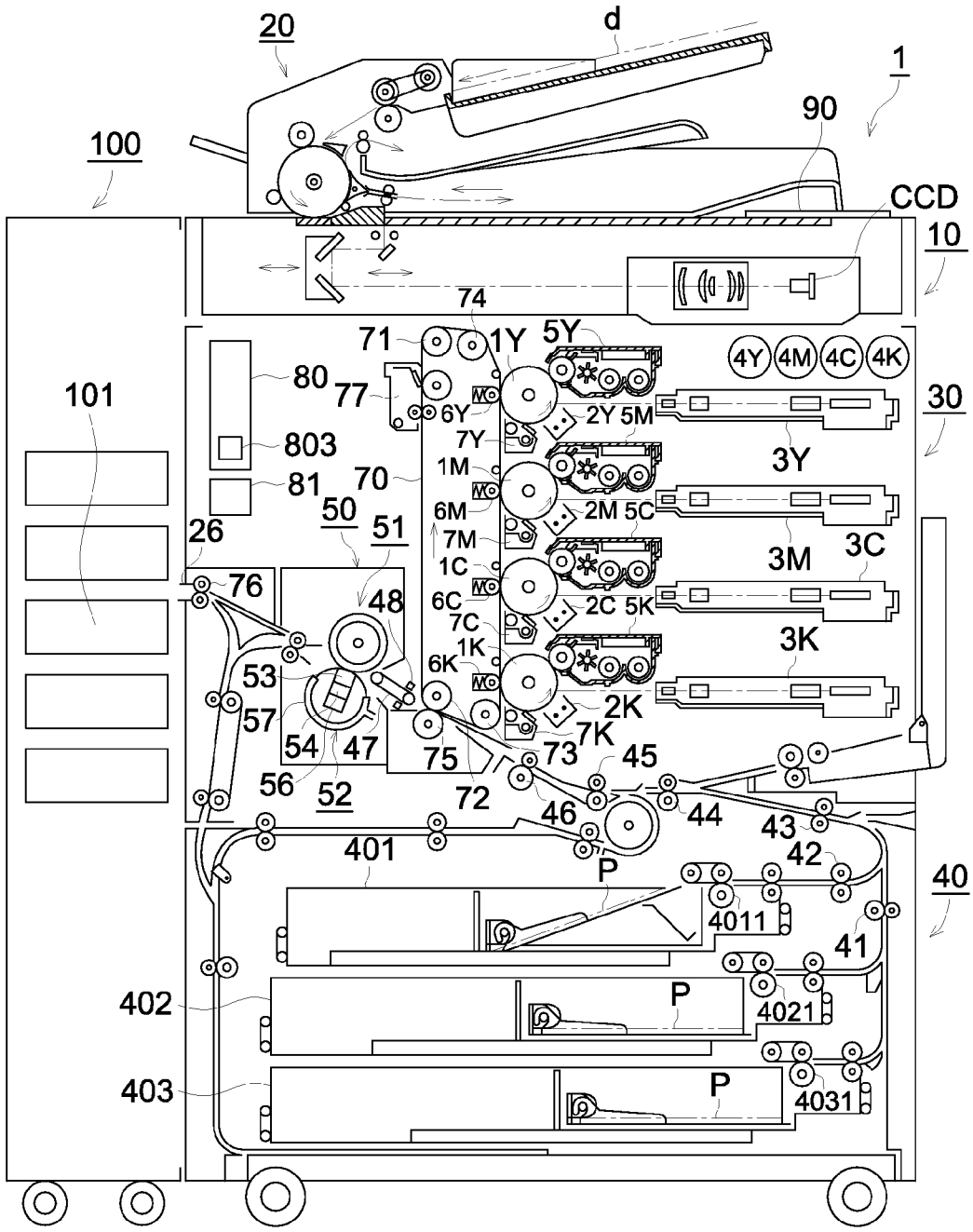
FIG. 1 is a structural diagram of a cross-section showing an example of an image forming apparatus having a fixing device.

FIG. 1 is a structural diagram of a cross-section showing an example of an image forming apparatus having a fixing device.

Image forming apparatus 1 has therein document image reading section 10, document conveyance section 20, image forming section 30, sheet supply section 40, fixing device 50, operation panel 90, and sheet collecting device 100 that stores fixed recording materials.

Recording materials used in the image forming apparatus include sheets in a form of a roll or in a form of a sheet and OHP sheets, and the recording material will be expressed as sheet P hereafter.

Document image reading section 10 and document conveyance section 20 are arranged above image forming section 30 which forms an image, and an image of document "d" conveyed by document conveyance section 20 is formed on line image sensor CCD by an optical system of the document image reading section 10, to be read in.

Analog signals converted photoelectrically by the line image sensor CCD are subjected to analog processing, A/D conversion, shading correction and image compression processing, in an unillustrated image processing section, to become digital image data in respective colors of Y (yellow), M (magenta), C (cyan) and K (black).

Drum-shaped photoconductors (which are called also photoconductors hereafter) 1Y, 1M, 1C and 1K each representing the first image carrier corresponding to each of colors of Y, M, C and K, are respectively charged evenly by charging devices 2Y, 2M, 2C and 2K.

Exposure devices 3Y, 3M, 3C and 3K corresponding to respective colors form latent images respectively on photoconductors 1Y, 1M, 1C and 1K based on digital image data for respective colors.

Toner in respective colors are supplied to developing units 5Y, 5M, 5C and 5K from toner replenishing devices 4Y, 4M, 4C and 4K for respective colors for replenishing fresh toner, whereby, latent images corresponding to respective colors formed on photoconductors 1Y, 1M, 1C and 1K are visualized with toner.

The developing units 5Y, 5M, 5C and 5K are arranged in tandem in the vertical direction, and on the left side of the photoconductors 1Y, 1M, 1C and 1K in the illustration, there is arranged intermediate transfer body 70 representing a semi-conductive endless-belt-shaped second image carrier that is wound around rollers 71, 72, 73 and 74 to be capable of rotating.

The intermediate transfer body 70 is driven to rotate in the direction of the arrow by the roller 71 and an unillustrated drive device connected to the roller 71.

Primary transfer rollers 6Y, 6M, 6C and SR corresponding to respective colors representing primary transfer devices are caused by an unillustrated control device to operate selectively depending on a type of an image, to press intermediate transfer body 70 against each of corresponding photoconductors 1Y, 1M, 1C and 1K.

A toner image of each color formed on each of photoconductors 1Y, 1M, 1C and 1K by each of developing units 5Y, 5M, 5C and 5K is transferred in succession onto rotating intermediate transfer body 70 by primary transfer rollers 5Y, 5M, 6C and 6K, and thus, a composite color image is formed.

After the toner image is transferred onto the intermediate transfer body 70 by primary transfer rollers 5Y, 5M, 6C and 6K, residual toner on each of photoconductors 1Y, 1M, 1C and 1K is removed by each of cleaning devices 7Y, 7M, 7C and 7K.

Meanwhile, photoconductors 1Y 1K, charging devices 2Y-2K, exposure devices 3Y-3K, toner replenishing devices 4Y-4K, developing units 5Y-5K, primary transfer rollers 6Y-6K, cleaning devices 7Y-7K, intermediate transfer body 70, rollers 71, 72, 73 and 74, secondary transfer roller 75 and cleaning device 77 which relate to image forming are expressed also as image forming section 30.

Sheet P stored in the first sheet supply cassette 401 is supplied by sheet supply roller 4011, and it passes through plural intermediate rollers 42, 43, 44 and 45 and through registration roller 46, to be conveyed to a secondary transfer roller section representing a secondary transfer device.

Then, the composite color image on the intermediate transfer body is transferred collectively onto sheet P by secondary transfer roller 75.

In the same way, sheet P stored in the second sheet supply cassette 402 and sheet P stored in the third sheet supply cassette 403 are respectively conveyed to secondary transfer roller 75 in case of need, and composite images on the intermediate transfer body are transferred collectively onto sheet P by the secondary transfer roller 75.

Further, the secondary transfer roller 75 is caused to press intermediate transfer body 70 and a sheet against roller 72, only when the sheet passes the secondary transfer roller 75 so that the secondary transfer is conducted.

A sheet onto which a color image has been transferred is subjected to fixing by fixing device 50, then, is interposed between sheet ejection rollers 76 and is ejected from discharge outlet 26 toward sheet collecting device 100 having plural sheet ejection trays, to be stacked on designated sheet ejection tray 101 in the sheet collecting device 100.

On the other hand, after the color image has been transferred on a sheet by secondary transfer roller 75, cleaning device 77 removes residual toner from intermediate transfer body 70 from which the sheet has been separated due to curvature.

Operation panel 90 has various types of switches and touch panels, and displays various types of information, and various pieces of operational information from various types of switches are inputted in control device 80.

Meanwhile, the fixing device 50 has therein fixing member 51, pressing section 53 that presses sheet P against the fixing member 51 through belt 52, pressure applying section 56 that generates pressing force proceeding toward the pressing section 53, pressing force transmission section 54 that is positioned between the pressing section 53 and the pressure applying section 56 and transmits the pressing force generated by the pressure applying section 56 to the pressing section 53 and guide 57 that guides the belt.

A heating method of the fixing device 50 may either be one to heat the fixing member 51 or be one to heat the belt 52.

When employing the heating method to heat the fixing member 51, the fixing member is made to be a heat roller. In this case, a heating source such as a halogen lamp can either be provided inside the heat roller, or be provided outside the heat roller.

When heating the belt 52 on the other hand, it is also possible to provide a heating source such as a halogen lamp on the outer circumference of the belt on the upstream side of the pressing section 53.

A method to provide a heating source such as a halogen lamp inside the fixing member 51 will be described as follows.

Hereinafter, the fixing member 51 will be expressed as heat roller 51.

FIG. 2 (*a*) is a structural diagram of a cross-section showing an example of a fixing device.

FIG. 2 (*a*) is a diagram wherein fixing device 50 is viewed in the direction which is the same as that in FIG. 1.

In FIG. 2 (*a*), the fixing device 50 has therein heat roller 51, pressing section 53, pressing force transmission section 54, pressure applying section 56, and guide 57.

The heat roller 51 has heater lamp 511 (halogen lamp) representing a heating source, mandrel 513 that is driven to rotate in the direction of arrow W1 by drive motor 512 that is a driving device, elastic layer 514 made of silicone rubber that covers an outer circumference of the mandrel 513 and covering layer 515 made of, for example, fluorine resin which covers an outer circumference of the elastic layer 514.

Belt 52 is guided by guide 57 that guides the belt 52, to be supported to be rotatable, and it is rotated by friction with heat roller 51 on a driven basis.

Then, nip portion N, namely a fixing area is formed by a surface of contact between the heat roller 51 and the belt 52 that is pressurized by pressure member 531, and a surface of images of sheet P is pressed by the belt 52 against the heat roller 51, so that fixing is conducted.

Pressing section 53 has therein the pressurizing member 531 representing the second elastic member provided on the side where contact thereof with the belt 52 is made, supporting member 532 that supports the pressurizing member 531 and is positioned on the side where contact thereof with the first elastic member 541 is made, and guide member 533 that is fixed on fixing device 50.

The pressurizing member 531 is composed of an elastic body (for example, silicone rubber), and its surface is covered by, for example, fluorine resin, for improving a sliding property and an abrasion resistance property between it and the belt 52.

The supporting member 532 is a flexible and thin plate material, and it is, for example, a metal having a thickness of 0.2-8 mm, preferably, a thickness of about 0.5-4 mm (for example, stainless steel, steel or the like), on which the pressurizing member 531 is fixed, and its flexibility disperses a pressure from pressing force transmission section 54 so that the pressure may not concentrate on one point.

Further, the supporting member 532 engages with guide member 533 to cause the pressurizing member 531 to be movable toward heat roller 51.

The pressing force transmission section 54 has a plurality of first elastic members 541 which are arranged in the direction identical to the longitudinal direction of pressing section 53 and transmit pressure of pressure applying section 56 to supporting member 532 of pressing section 53 and elastic material supporting member 542 by which a plurality of first elastic members 541 are arranged to be supported.

The first elastic members 541 have different elastic coefficients, and stress depending on the elastic coefficient and on compression is generated by compression.

Further, the first elastic member 541 has only to be one wherein compression generates stress that corresponds to the compression, and a compression spring, for example, is used suitably.

Hereinafter, the first elastic member 541 will be expressed as compression spring 541.

The elastic material supporting member 542 is a metal plate having a thickness of 0.5-10 mm, preferably, a thickness of about 1-7 mm (for example, stainless steel, steel or the like), and it is guided by guide member 533 to cause plural first elastic members 541 to be movable toward heat roller 51.

Further, the elastic material supporting member 542 supports plural compression springs 541, and transmits pressure of pressure applying section 56 to compression springs 541.

The pressure applying section 56 has cam 561 that moves the elastic material supporting member 542 toward heat roller 51 and cam drive motor 562 that drives cam 561 to rotate.

The cam 561 is in a form of an eccentric cam, and rotation of cam 561 moves the elastic material supporting member 542 in the direction of arrow W2.

Then, the pressurizing member 531 is moved toward heat roller 51 through plural compression springs 541 and supporting member 532 to change pressurizing force of pressurizing member 531 against the heat roller 51.

Cam drive motor 562 is controlled by control device 80, and stop position of cam 561 is changed depending on information relating to recording materials, for example, information about types of sheet P (thick sheet, or regular paper), or information relating to the state of finishing by fixing on the surface of recording material (gloss of an image).

Owing to the foregoing, pressing force for pressing the pressing force transmission section 54 against pressing section 53 is changed depending on information relating to recording materials or information relating to the state of finishing by fixing of the surface of the recording material, resulting in a change of pressurizing force F of pressing section 53 against the heat roller 51.

FIG. 2 (*b*) shows an occasion wherein cam 561 is located at high pressure position A.

FIG. 2 (*c*) shows an occasion wherein cam 561 is located at regular position B.

The stop position of cam 561 has two positions including regular position B wherein convex portion 5611 of cam 561 is located at the side opposite to heat roller 51, and ordinary pressurizing force is generated [see FIG. 2 (*c*)] and illustrated high pressure position A wherein convex portion 5611 of cam 561 is located at heat roller 51 side, and pressurizing force that is greater than ordinary pressurizing force is generated [see FIG. 2 (*b*)].

Therefore, in the case of high pressure position A, belt 52 is caused to make contact with heat roller 51 with large pressurizing force through pressing force transmission section 54 and pressing section 53, and in the case of regular position B, belt 52 is caused to make contact with heat roller 51 with ordinary pressurizing force through pressing force transmission section 54 and pressing section 53.

In this case, the ordinary nip pressure is nip pressure with which an image quality is not damaged, for example, when obtaining ordinary gloss as information concerning the state of finish by fixing on the surface of a recording material, under the conditions of regular paper as information of sheet type, while higher nip pressure is nip pressure with which an image quality is not damaged when obtaining high gloss as information about the state of finish by fixing on the surface of a recording material, under the condition of a thick sheet as the sheet type.

Meanwhile, when a cam shape is made to be in a polygon (not shown) wherein distances from a shaft center to respective vertexes of the polygon are different from each other, and when the cam is stopped at each vertex, it is also possible to obtain many different pressures.

FIG. 3 is a partial sectional view of a fixing device.

Incidentally, FIG. 3 is a partial sectional view that is viewed in the direction of arrows Z-Z' in FIG. 2 (*a*).

As stated above, pressing force transmission section 54 has a plurality of compression springs 541 which are arranged in the same direction as the longitudinal direction (direction of an arrow W3) of pressing section 53.

Among a plurality of first elastic members 541, an elastic coefficient of the first elastic member positioned at a central portion in the longitudinal direction of the pressing section 53 is set to be greater than those of elastic members positioned at both end portions in the longitudinal direction of the pressing section 53.

An occasion wherein plural first elastic members 541, for example, five first elastic members 541 exist will be described below.

Among five compression springs, compression springs positioned at both ends are expressed as first compression spring 541*a* and fifth compression spring 541*e*, compression springs positioned closer to the center than the both ends are, are expressed as second compression spring 541*b* and fourth compression spring 541*d*, and a compression spring positioned at the center is expressed as third compression spring 541*c*.

Among a plurality of compression springs 541, spring constants of 541*a* and 541*e* positioned respectively at both ends of pressing section 53 in the longitudinal direction are set to be smaller than compression springs of the second compression spring 541*b* and the fourth compression spring 541*d* positioned closer to the center than the both ends are, and spring constants of the second compression spring 541*b* and the fourth compression spring 541*d* are set to be smaller than spring constant of the third compression spring 541*c* positioned at the center.

In other words, a spring constant of a compression spring positioned at the center of pressing section 53 is set to be greater than a spring constant of a compression spring that is positioned closer to the end than the center is.

Therefore, the first compression spring 541*a* and the fifth compression spring 541*e*, the second compression spring 541*b* and the fourth compression spring 541*d* and the third compression spring 541*c* cause the pressing section 53 to receive mound-shaped pressure whose central portion in the longitudinal direction is made to be convex (maximum).

The aforesaid set of a spring constant of the compression spring wherein the central portion is convex (maximum) is a countermeasure to be taken so that distribution of nip pressure in the longitudinal direction may be uniform, because nip pressure at the central portion is generally lower.

However, depending on the structure of an apparatus and on a type of recording material, the nip pressure at the central portion is not always lower, and in this case, a spring constant for the position that corresponds to the portion where the nip pressure is low is set to be large to uniform distribution of nip pressure in the longitudinal direction.

Though it is preferable that the number of pressing force transmission members 541 is three or more for the simple structure, and it is more preferable that the number is about five mentioned above. When distribution of nip pressure before installing springs is uneven, it is also possible to provide pressing force transmission members whose number corresponds to distribution of nip pressure at the position corresponding to the nip pressure distribution.

As stated above, the pressure applying section 56 has cam 561 that moves elastic material supporting member 542 toward heat roller 51 and cam drive motor 562 that drives cam 561 to rotate.

Then, pressurizing member 531 is moved toward heat roller 51 through elastic material supporting member 542, first compression spring 541*a*-fifth compression spring 541*e* and supporting member 532 that is guided by guide member 533, so that pressurizing force of pressurizing member 531 against heat roller 51 may be changed.

The cam drive motor 562 is controlled by control device 80, and a stop position of cam 561 is determined in accordance with information about a sheet to be fixed or with information about quality of fixing, and pressurizing force of pressurizing member 531 against heat roller 51 is changed in accordance with information about a sheet to be fixed or with information about quality of fixing.

In FIG. 3, heat roller 51, belt 52 and pressurizing member 531 are illustrated to be away from each other for the illustration that is easy to understand. However, they are in close contact with each other as shown in FIG. 2 (*a*).

It is possible to make the nip pressure to be variable by means of pressure applying section 56 of the fixing device described above in accordance with information about a recording material, for example, information about a type of sheet P, or with information about the state of finish by fixing on the surface of recording material, and it is possible to make the nip pressure in the longitudinal direction of the heat roller to be constant by pressing force transmission section 54.

Owing to the foregoing, it is possible to provide a structurally simple and small fixing device which makes it possible to obtain high-quality output images having no image defects regardless of information about recording material, for example, information about a type of sheet P, or of information about the state of finish by fixing on the surface of recording material, and to provide an image forming apparatus equipped with the aforesaid fixing device.

FIG. 4 is a block diagram relating to control of a fixing device and an image forming apparatus.

The image forming apparatus has therein control device 80, operation panel 90 connected to the control device 80, document image reading section 10, document conveyance section 20, image forming section 30, sheet supply section 40, fixing device 50, and sheet collecting device 100 and communication device 81.

The control device 80 has therein CPU (Central Processing Unit) 802, RAM 803, ROM 804, I/O controller 806 and bus 801 that connects the foregoing mutually.

Further, the I/O controller 806 controls document image reading section 10, document conveyance section 20, image forming section 30, sheet supply section 40, fixing device 50, and sheet collecting device 100, operation panel 90 and communication device 81, under the control of CPU 802.

In the ROM 804, there are stored in advance a program that controls an overall image forming apparatus and screen display information that displays a screen on which various types of information are inputted, for example, a sheet type selection screen (not shown) where type information of sheet P (thick paper, regular paper and others) is inputted, for example, gloss selection screen (not shown) on which gloss information of images is inputted.

The programs and screen display information stored in ROM 804 are stored in RAM 803 by CPU 802, and are read out as occasion demands, thus, the control described later is conducted.

Operation panel 90 representing an information setting device has various switches (start-up keys 901) and touch panels (not shown), and inputs operation information of various switches in control device 80 through I/O controller 806 under the control of control device 80.

It further conducts displays of a screen of each operation switch (sheet supply cassette key 902 or the like), a selection screen of information relating to a recording material, for example, of a type of sheet P (thick sheet, regular sheet or the like) and a selection screen of the state of finish by fixing on the surface of recording material [gloss of images (high gloss, ordinary gloss)].

Operation information of an operation switch displayed on an operation screen and operation information of the selection screen are inputted in control device 80.

Owing to this, the operation panel 90 makes it possible to input information about recording material, for example, a type of sheet P (thick paper, regular paper or the like) and information about the state of finish by fixing on the surface of recording material (high gloss, ordinary gloss).

When start-up information is inputted from operation panel 90 through I/O controller 806 under the control of control device 80, document image reading section 10 reads a document image and inputs document image information in control device 80.

Then, the control device 80 processes document image information read by document image reading section 10 to make it to be digital image information, and causes the digital image information to be stored in, for example, an unillustrated HDD (Hard Disc Drive).

Communication device 81 is connected to outside PC (personal computer), an image forming apparatus, or server 812, through network 811 or the like, to conduct transmitting and receiving of digital image data with them through I/O controller 806 under the control of control device 80.

Then, the control device 80 causes the aforesaid HDD or the like to store digital image data received by communication device 81.

Image forming section 30 forms a toner image on a photoconductor based on digital image information read out from RAM 803 through I/O controller 806 under the control of control device 80. Then, the toner image is caused to be transferred onto a sheet that is supplied from a sheet supply cassette, based on sheet supply cassette information inputted from operation panel 90.

Sheet supply section 40 supplies a sheet from the prescribed sheet supply cassette, through I/O controller 806 under the control of control device 80.

Fixing device 50 has drive motor S12 that drives heat roller 51 to rotate, heater lamp 511 that heats the heat roller 51 and cam drive motor 562 that drives cam 561 of pressure applying section 56 and moves the cam 561 to either one of high pressure position A and regular pressure position B.

Then, temperature regulation of heat roller 51 is conducted by ON/OFF of the heater lamp 511, through I/O controller 806 under the control of control device 80.

Further, rotary drive of heat roller 51 is conducted by ON/OFF of drive motor 512, and positioning of cam 563 is conducted by positioning drive of cam drive motor 564.

Sheet collecting device 100 stacks a sheet subjected to fixing on a prescribed storage tray among plural storage trays 101, through I/O controller 806 under the control of control device 80.

Control methods for the fixing device and for the image forming apparatus will be described as follows.

Unless otherwise described, the following control is conducted by control device 80.

FIG. 5 is a flow chart relating to control of an image forming apparatus.

1. Reading of Information about Recording Material to be Fixed [for Example, Information of a Type of Sheet P (Thick Paper, Regular Paper or the Like)] and Information of Fixing Quality [Information about the State of Finish by Fixing On Surface Of Recording Material (Gloss Of Images)] (Step S101)

Image display information of information about recording material, for example, a selection screen of a type of sheet P (thick paper, regular paper or the like) (not shown) and a selection screen of the state of finish by fixing on surface of recording material [gloss of images (high gloss, ordinary gloss)] (not shown) are read out from ROM 804, and selection screen of a type of sheet P (thick paper, regular paper or the like) and selection screen of gloss of images (high gloss, ordinary gloss) are displayed on operation panel 90.

Then, when information of either one a regular paper or a thick paper selected in types of sheet P (thick paper, regular paper) is inputted, the inputted information is caused to be stored in RAM 803.

Further, when either one of information of ordinary or high gloss selected on the selection screen of image gloss (high gloss, ordinary gloss) is inputted, the inputted information is caused to be stored in RAM 803, and the control advances to the succeeding step.

It is also possible to monitor sheet supply cassette key 902 which selects the sheet supply cassette that supplies sheets, and to cause operation information of the sheet supply cassette key 902 to be stored in RAM 803.

2. Setting of Pressure by Cam 563 (Step S102)

A position for cam 563 to be stopped is determined in accordance with information of a sheet type and information of gloss selected in step S101, and the control advances to the succeeding step.

Meanwhile, refer to the flow in FIG. 6 about positioning of the stop position of cam 563.

3. Monitoring of Start-Up (Step S103)

Start-up key 901 of operation panel 90 is monitored, and when ON of the start-up key is detected (Yes), the control advances to the succeeding step, and when ON is not detected (No), step S103 is repeated until the moment when the start-up key is turned ON.

4. Reading of Document (Step S105)

Document conveyance section 20 is caused to convey document "d" and document image reading section 10 is caused to read document images. Then, A/D conversion and others are conducted, and digital image information of the document is obtained to advance to the succeeding step.

5. Image Forming (Step S105)

Image forming section 30 is caused to form a toner image on a photoconductor based on digital image information of the document, and the control advances to the succeeding step.

6. Supplying of Sheet (Step S106)

Sheet supply section 40 is caused to supply a sheet from a sheet supply cassette stored in step S101, and a toner image is transferred onto the sheet, thus the control advances to the succeeding step.

7. Fixing (Step S107)

Fixing device 50 is caused to conduct fixing, and the control advances to the succeeding step.

In this case, fixing is conducted while the cam 563 is at the stop position determined in step S102.

8. Sheet Ejection (Step S108)

Ejected sheets are stacked on sheet collecting device 100.

Then, according to job conditions set in advance, step S106-step S108 are repeated until the moment when image forming and fixing for prescribed number of sheets are conducted, and when they are finished, the control advances to the end.

FIG. 6 is a flow chart relating to setting of pressure by a cam of a fixing device.

1. Reading of Information (Information of Types of Sheets) Relating to Recording Material to be Fixed Stored in S101 (Step S201)

Information of either one of regular paper or thick paper stored in RAM 803 in step S101 is read, and the control advances to the succeeding step.

2. Decision of Sheet Type "Regular Paper" (Step S202)

When the information thus read indicates "regular paper" (Yes), the control advances to step S204, and when the information is not "regular paper" (No), the control advances to step S203.

3. Decision of Sheet Type "Thick Paper" (Step S203)

When the information thus read indicates "thick paper" (Yes), the control advances to step S205, and when the information is not "thick paper" (No), the control advances to step S204.

4. Moving Cam 563 to Regular Position B (Step S204)

By driving cam drive motor 564 to move cam 563 to regular position B and to lower elastic material supporting member 542, and the control advances to step S206.

5. Moving Cam 563 to High Pressure Position A (Step S205)

By driving cam drive motor 564 to move cam 563 to high pressure position A and to raise elastic material supporting member 542, and the control advances to step S103.

6. Reading of Fixing Quality Information (Gloss Information) [Information Relating to the State of Finish by Fixing on Surface of Recording Material (Gloss of Image)] Stored in Step S101 (Step S206)

Information of either one of high gloss and ordinary gloss which is stored in RAM 803 in step S101 is read, and the control advances to the succeeding step.

7. Decision of Gloss Information "Ordinary" (Step S207)

When the information thus read indicates "ordinary" (Yes), the control advances to step S209, and when the information is not "ordinary" (No), the control advances to step S208.

8. Decision of Gloss Information "Gloss: High Gloss" (Step S208)

When the information thus read indicates "gloss: high gloss" (Yes), the control advances to step S210, and when the information is not "gloss: high gloss" (No), the control advances to step S209.

9. Moving Cam 563 to Regular Position B (Step S209)

Description of this is omitted because this is the same as step S204. However, the control returns to step S103.

10. Moving cam 563 to high pressure position A (step S210)

Description of this is omitted because this is the same as step S205.

Owing to the aforesaid flows shown in FIG. 5 and FIG. 6, by making a change of nip pressure possible in accordance with information about the recording material, for example, information about a type of sheet P (thick paper, regular paper or the like), or information about the state of finish by fixing on the surface of recording material (high gloss, ordinary gloss), and by setting a spring constant of the spring positioned at the central section in the longitudinal direction of pressing section 53 among the aforementioned plural springs 541 to be greater than a spring constant of the spring positioned closer to the ends in the longitudinal direction, it is possible to make the nip pressure to be uniform in the longitudinal direction.

Owing to the foregoing, it is possible to obtain high-quality output images having no image defects regardless of information about recording material, for example, information about a type of sheet P (thick paper, regular paper or the like), or of information about the state of finish by fixing on the surface of recording material (high gloss, ordinary gloss).

FIG. 7 (*a*) and FIG. 7 (*b*) are diagrams showing nip pressure distribution of conventional fixing device conceptually.

FIG. 7 (*a*) is a conceptual diagram of a conventional fixing device wherein the numeral 51 represents a heat roller, 52 represents a belt, and 53' represents a pressure roller for biasing bearings 531' at both ends toward heat roller 51. FIG. 7 (*b*) is one showing a nip pressure distribution on a fixing roller in its longitudinal direction on an occasion where ordinary pressure is applied and on an occasion where high pressure is applied on a thick recording sheet for example in a conventional fixing device. When ordinary pressure is applied on each of bearings 531' at both ends, no distortion is caused on the roller, average pressure value is low, and nip pressure distribution "h" is almost flat.

However, when high pressure is applied on bearings 531' at both ends, an average pressure value is high, and it cannot cope with the distortion of the roller, resulting in nip pressure distribution "i" wherein the nip pressure at the central portion is lower than those of both ends.

FIG. 8 (*a*) and FIG. 8 (*b*) are diagrams showing nip pressure distribution of a fixing device of the present embodiment conceptually.

FIG. 8 (*a*) is a conceptual diagram of a fixing device of the present embodiment wherein the numeral 51 represents a heat roller, 52 represents a belt, 53 represents a pressing section, 54 represents a pressing force transmission section, 56 represents a pressure applying section, 541*a* represents the first compression spring, 541*b* represents the second compression spring, 541*c* represents the third compression spring, 541*d* represents the fourth compression spring and 541*e* represents the fifth compression spring.

FIG. 8 (*b*) shows nip pressure distribution when ordinary pressure is applied and nip pressure distribution when high pressure is applied on a thick recording sheet.

When ordinary pressure is applied by pressure applying section 56, an average pressure value is low, and no distortion of the roller is caused, whereby nip pressure distribution "j" is almost flat.

When high pressure is applied by pressure applying section 56, an average pressure value is high, and springs whose spring constants become greater gradually, as being closer to the central portion (541*c*) from both end portions (541*a*, 541*e*) are provided. Therefore, stress coping with the distortion on the central portion of the roller can be generated, and nip pressure distribution "k" is almost flat.

As stated above, the invention has an effect so that the overall nip pressure (average value) can be changed without changing greatly surface pressure (nip pressure) distribution in the longitudinal direction of heat roller 51, by providing springs whose spring constant grows greater gradually toward the central portion from both end portions.

Even when pressure by a pressing section is increased by trying to increase nip pressure between a fixing roller and a belt in accordance with information about recording material to be fixed or information of fixing quality, it is possible to make nip pressure of a fixing roller in its longitudinal direction to be constant independently of the aforesaid information.

Further, owing to the foregoing, it is possible to provide a structurally simple and small fixing device which makes it possible to obtain high-quality output images having no image defects regardless of information about recording material to be fixed, or of information of fixing quality, and to provide an image forming apparatus equipped with the aforesaid fixing device.

What is claimed is:

1. A fixing device which conducts a fixing process by heating and pressing a recording material, the fixing device comprising:

a fixing member;

a belt which conveys the recording material in a recording material conveyance direction between the fixing member and the belt;

a pressing section whose longitudinal direction is perpendicular to the recording material conveyance direction and which presses the recording material against the fixing member through the belt;

a pressure applying section which generates pressing force; and a pressing force transmission section which is positioned between the pressing section and the pressure applying section and which transmits the pressing force to the pressing section, the pressing force transmission section comprising a plurality of first elastic members which are arranged in a same direction as the longitudinal direction of the pressing section and have a plurality of different elastic coefficients.

2. The fixing device of claim 1, wherein, among the plurality of first elastic members, an elastic coefficient of a first elastic member which is positioned in a central portion in the longitudinal direction of the pressing section is greater than elastic coefficients of first elastic members which are positioned at both ends in the longitudinal direction of the pressing section.

3. The fixing device of claim 1, wherein the first elastic members are compression springs and the elastic coefficients are spring constants of the compression springs.

4. The fixing device of claim 1, wherein the pressure applying section changes the pressing force for pressing the pressing force transmission section toward the pressing section according to information relating to the recording material or information relating to a state of finish by fixing on a surface of the recording material.

5. The fixing device of claim 1, wherein the pressing section comprises:

a second elastic member which is made of rubber and is provided on a side where the second elastic member is in contact with the belt; and a supporting member made of a flexible plate member, which supports the second elastic member and which is positioned on a side where the supporting member is in contact with the first elastic member.

6. The fixing device of claim 5, wherein the plate member is metal.

7. The fixing device of claim 1, wherein the fixing member is a heat roller containing a heating body.

8. An image forming apparatus comprising the fixing device of claim 1.

9. The image forming apparatus of claim 8, further comprising:

an information setting device for setting information relating to the recording material or information relating to a state of finish by fixing on a surface of the recording material.

10. A device for fixing an image by heating and pressing a recording material, comprising:

a fixing member;

a belt for conveying the recording material between the fixing member and the belt;

a pressing assembly that is configured to press against the belt and thereby press the recording material against the fixing member, said pressing assembly including:

a pressure generating device that generates a pressing force;

a pressurizing member for pressing against the belt; and a pressing force transmission assembly which is positioned between the pressure generating device and the pressurizing member and which is configured to transmit the pressing force to the pressurizing member, the pressing force transmission assembly including a plurality of elastic members arranged along a longitudinal direction of the pressing assembly, which is transverse to a recording material conveyance direction, said elastic members having a plurality of different elastic coefficients.

11. The fixing device of claim 10, wherein an elastic coefficient of an elastic member which is positioned in a central portion along the longitudinal direction of the pressing assembly is greater than elastic coefficients of elastic members which are positioned at the ends along the longitudinal direction of the pressing assembly.

12. A image forming apparatus comprising:

an image forming device;

a recording material supplying device;

a fixing device, said fixing device, comprising:

a fixing member;

a belt for conveying the recording material between the fixing member and the belt;

a pressing assembly that is configured to press against the belt and thereby press the recording material against the fixing member, said pressing assembly including:

a pressure generating device that generates a pressing force;

a pressurizing member for pressing against the belt; and a pressing force transmission assembly which is positioned between the pressure generating device and the pressurizing member and which is configured to transmit the pressing force to the pressurizing member, the pressing force transmission assembly including a plurality of elastic members arranged along a longitudinal direction of the pressing assembly, which is transverse to a recording material conveyance direction, said elastic members having a plurality of different elastic coefficients.

* * * * *